US005520284A

United States Patent [19]

Gray

[11] Patent Number: 5,520,284

[45] Date of Patent: May 28, 1996

[54] AUTO-BOTTOM FRONT LOCK CARTON

[75] Inventor: Larry D. Gray, Chesterfield, Va.

[73] Assignee: Westvaco Corporation, New York, N.Y.

[21] Appl. No.: 404,733

[22] Filed: Mar. 15, 1995

[51] Int. Cl.[6] ..... B65D 21/032

[52] U.S. Cl. ..... 206/509; 229/117.25; 229/117.19; 229/149; 229/915

[58] Field of Search ..... 229/117.25, 915, 229/117.14, 117.15, 117.19, 117.23, 117.24, 141, 149; 206/509

[56] References Cited

U.S. PATENT DOCUMENTS

| | | | |
|---|---|---|---|
| 2,352,123 | 6/1944 | Ringler | 229/117.25 |
| 3,529,763 | 9/1970 | Wagner . | |
| 3,589,594 | 6/1971 | Fischlein | 229/117.25 |
| 3,949,931 | 4/1976 | Hall | 229/149 X |
| 4,349,147 | 9/1982 | Jensen | 229/915 |
| 4,516,718 | 5/1985 | Forbes, Jr. . | |
| 4,607,786 | 8/1986 | Weaver | 229/149 X |
| 4,674,676 | 6/1987 | Sandel et al. | 229/149 |
| 4,765,534 | 8/1988 | Zion et al. | 229/149 X |
| 4,775,093 | 10/1988 | Lin | 229/117.25 |
| 4,981,254 | 1/1991 | Depper | 229/117.14 |

FOREIGN PATENT DOCUMENTS

| | | | |
|---|---|---|---|
| 2356076 | 5/1975 | Germany | 229/117.25 |

*Primary Examiner*—Allan N. Shoap
*Assistant Examiner*—Christopher J. McDonald

[57] ABSTRACT

The carton of the present invention is formed from a one-piece blank of foldable paperboard or the like which includes, an automatic bottom closure, a top closure having a front lock, and remote side wall extensions which include slots and tabs to permit a plurality of the cartons when stacked to be secured together, or for the use of a separate carrying handle.

3 Claims, 3 Drawing Sheets

AUTO-BOTTOM FRONT LOCK CARTON

BACKGROUND OF THE INVENTION

The present invention relates to a carton formed from foldable sheet material, such as paperboard, primarily for use in packaging food products, particularly for the fast food industry.

The manufacture of food cartons, particularly for the fast food industry, involves highly developed technology. Such cartons must be designed for maximum economy and utility with emphasis on ease of use, cost effectiveness, handling, filling, and closing. Product identification, storage of cartons for end use, and integrity after being filled are also important. When such cartons are to be used for hot foods, design considerations must be incorporated into the carton structure to provide a quick and easy means for loading and closing the carton to keep the food hot, and for retaining the lids closed until the food is to be served. Conversely, the means for keeping the lids closed must be readily releasible by the consumer when the foods are to be consumed. Preferably, the means for keeping the lids closed should be automatically engaged upon closing, and easily released when desired.

Likewise, it is desirable in such cartons to provide a means for stacking a plurality of cartons, one on top of the other, for carryout use. When stacked, the cartons should include some mechanism for retaining the plurality of cartons in a stack. Likewise, it is useful and desirable to provide a readily accessible carry handle for ease of carrying one or more filled cartons. However, even though a clear need has existed in the fast food industry for a carryout carton with an effective, positive, automatic closure, good stacking ability and the bonus of providing a readily available carry handle, no such package exists in the prior art. Thus, while U.S. Pat. No. 3,529,763 discloses a typical automatic bottom as employed in the present invention, and U.S. Pat. No. 4,516,718 discloses a type of front locking closure that is related to the design used herein, it has not been obvious to the prior workers in the field to design a single carton which satisfies all of the above desirable features substantially as disclosed herein.

SUMMARY OF THE INVENTION

Specifically, the carton of the present invention comprises a generally rectangular structure prepared from a single blank of paperboard or the like, that is preformed, glued, and shipped in a collapsed condition. For this purpose, the carton preferably has an autolock bottom, a pair of opposed side walls, a front wall and a rear wall, all interconnected together, and a top closure flap that is preferably foldably attached to the rear wall. The novel features of the carton include side wall extensions which extend upwardly above the top closure flap when the carton is set up, a front locking element integral with the top closure flap which may be securely locked and retained in a locking slot provided therefor, means in the front wall for releasing the locking element from the locking slot to open the carton, cooperating means in both of the adjacent side walls and the side wall extensions for securing stacked cartons together, and an auxiliary carrying strap that may be attached to the side wall extensions, if desired, for readily carrying either a single carton or a plurality of stacked cartons. It is contemplated that the carton may have either straight or tapered sides depending upon the application intended.

With respect to the autolock bottom construction, it is of generally conventional design well known to those skilled in the art. The side wall extensions are preferably of generally triangular shape, with a base along the side wall, and substantially equal length sides extending upwardly therefrom to an apex. It should be understood, however, that the side wall extensions may take many different shapes including square, rectangular or rhomboidal. Each of the side wall extensions include integral tab elements cut therefrom and located therein along score lines that are generally parallel to the score lines between the front wall and the dust flap, and the rear wall and the top closure flap. These score lines may take the form of perforated lines if it is desired to remove the top portions of the side wall extensions for separating stacked and interconnected cartons. However, is a preferred embodiment a reinforcing element such as reinforcing tape is provided along each score line in each side wall extension to strengthen the side wall extensions in the area of the tab elements and provide assistance in separating the tab elements from the locking slots of another stacked carton when it is desired to do so.

The locking element for the closure flap of the carton preferably comprises a tongue element constructed so as to have a first tapered portion and culminating in a pair of shoulder portions at each side thereof. Indented inwardly from the shoulder portions there is a connector portion, of less width than the shoulder portions, which is foldably attached to the front edge of the carton lid. A cooperating locking slot is located along the fold line between the front wall and front wall dust flap.

The locking slot has a length substantially equal to the width of the tongue element from shoulder-to-shoulder, for accepting the tongue element, to securely lock the closure flap in the closed condition after the carton is filled. For opening the carton, an access flap is provided in the front wall of the carton. The access flap is formed in the front wall by a pair of perforated lines which extend from the ends of the locking slot to a score line also located in the front wall. The perforated lines may extend generally perpendicular to the locking slot for an abbreviated distance into the front panel or may be oriented at an angle thereto. In any event, the access flap is provided for the purpose of giving access to the locking tab to open the carton. For this purpose, the access flap is torn and folded downwardly away from the front panel along its fold line to expose the locking tab of a closed carton.

In order to aid in retaining stacked cartons together, each of the side walls are provided with a pair of locking slots preferably in the form of generally U-shaped cut lines which face away from one another. When two cartons are stacked together, the locking slots in each side wall extension are used to capture both the apex of each side wall extension and the locking tab formed in the side wall extension. When a carrying handle is to be used, similar locking slots are formed by cut lines in each end of the carry handle, like those provided in the side walls of the carton, for capturing the side wall extension apexes and the side wall extension tab elements.

The above described arrangement of parts provides for easy and efficient set up of a formed carton from its initial flattened condition. Once squared for use, the carton may be readily filled and closed as aforesaid by inserting the locking tongue in the locking slot. If it is desired to stack two or more filled cartons, the apex and integral tab element of each side wall extension may be readily manipulated for insertion into the U-shaped locking slots provided in each side wall extension. Further, if a handle is applied, it is readily attached to the side wall extension of the top most stacked carton in a like manner. For separating stacked cartons, the apexes and tab elements of each side wall extension are removed from the locking slots in each side wall extension, and the cartons are opened by tearing and folding outwardly the access flaps to release the locking tabs.

It is thus a general object of the present invention to provide a food carton prepared from a single blank of paperboard which is arranged for stacking or single use, and which is constructed so that when it is filled, closed and locked, it is unlikely to be accidently opened upon careless handling.

A more specific object of the present invention is the provision of a locking tongue which is shaped to be guided into its locking slot where the locking elements become securely engaged, and which may be released upon the manipulation of an access flap which exposes the locking tongue.

The foregoing description is indicative in a general way of the nature and scope of the present invention. Other and more specific advantages will be apparent to those skilled in the art upon a full understanding of the construction and operation of the improved carton and its novel features disclosed more fully hereinafter.

DETAILED DESCRIPTION

Figure 1:
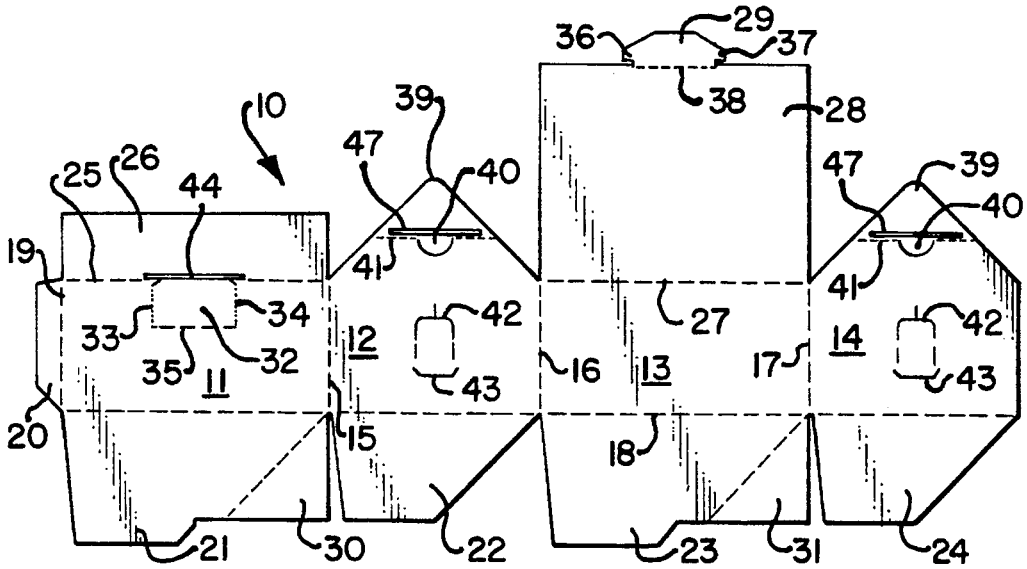
FIG. 1 is a plan view of a cut and scored paperboard blank for forming a carton according to the preferred embodiment of the present invention.

Referring particularly to FIG. 1, there is illustrated a blank 10 useful for making the carton of the present invention. The blank includes a pair of substantially identical side wall panels 12 and 14, a front wall 11, and a rear wall 13, foldably connected to one another along fold lines 15, 16 and 17. A glue flap 20 is foldably attached to front wall 11 along fold line 19 for use in securing the carton walls together. In a typical construction, flap 20 is adhered to the inside of side wall 14. Meanwhile, a plurality of bottom closure flaps 21, 22, 23 and 24 are foldably attached to the primary carton panels along a fold line 18. These flaps are typical for a self locking bottom closure as is well known in the art. For this purpose, the portions 30 and 31 of bottom flaps 21 and 23 are adhered to the adjacent flaps 22 and 24 respectively so that they stay connected whether the carton is collapsed or set up.

Front wall 11 may include a dust flap 26 that is folded inside the carton when the carton is closed. If included, it is foldably attached to the upper edge of front wall 11 along a fold line 25. In addition, front wall 11 includes an access flap 32 formed therein by a pair of spaced apart perforated lines 33, 34 that terminate at a fold line 35. At the top of flap 32, a locking slot 44 is formed along the fold line 25. The locking slot 44 is preferably slightly longer than the width of access flap 32. Rear wall 13 preferably includes a top closure flap 28 foldably attached to the upper edge thereof along a fold line 27. In addition rear wall 13 includes a locking tongue element 29 attached to the free end thereof. Tongue element 29 is preferably constructed to include a first tapered leading portion culminating in a pair of shoulder portions 36, 37 which extend beyond the ends of the part 38 of the tongue element 29 that is foldably connected to the closure flap.

Side walls 12 and 14 each include integral extensions which extend above the nominal height of the other walls of the carton. Each of these side wall extensions culminate in an apex tab element 39 which is ultimately used to secure stacked cartons together or to attach a separate handle element. The side wall extensions also include tab members 40 cut therefrom and attached thereto along fold lines 41. In an alternative embodiment, these fold lines may be reinforced by a length of reinforcing tape 47 or the like. Side walls 12 and 14 further include opposed locking slots 42, 43 cut therein which are designed to cooperate with the tab members 40 and apexes 39 of each side wall extension of another carton when the cartons are stacked.

Figure 2:
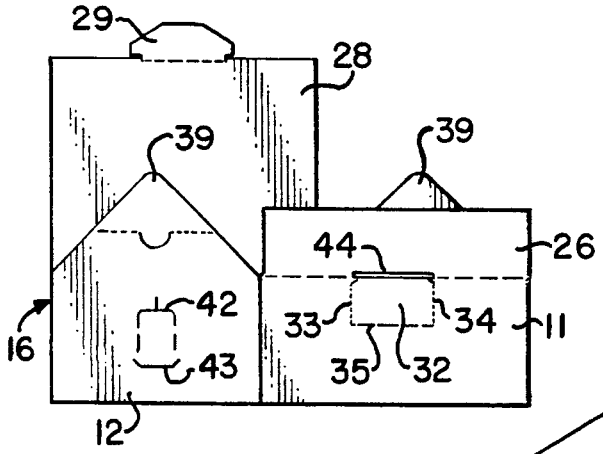
FIG. 2 is a plan view of a carton prepared from the blank of FIG. 1 in collapsed condition.
Figure 3:
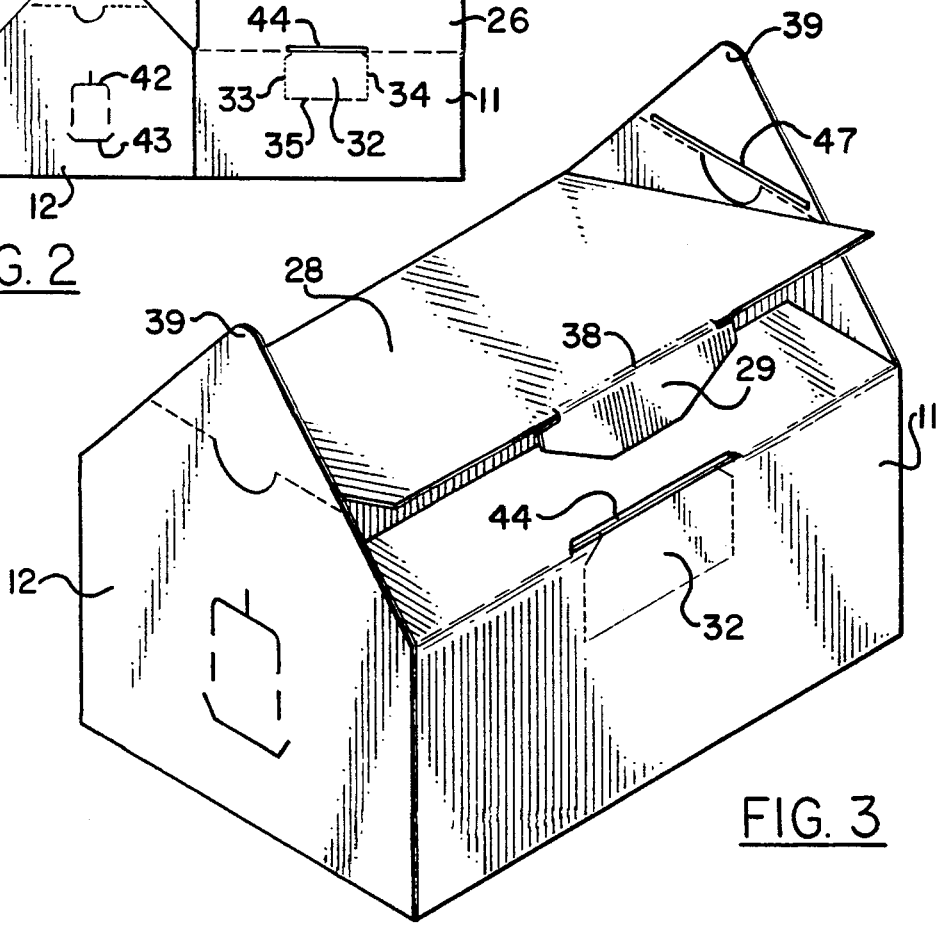
FIG. 3 is a perspective view of a carton according to the present invention in its set-up condition.
Figure 4:
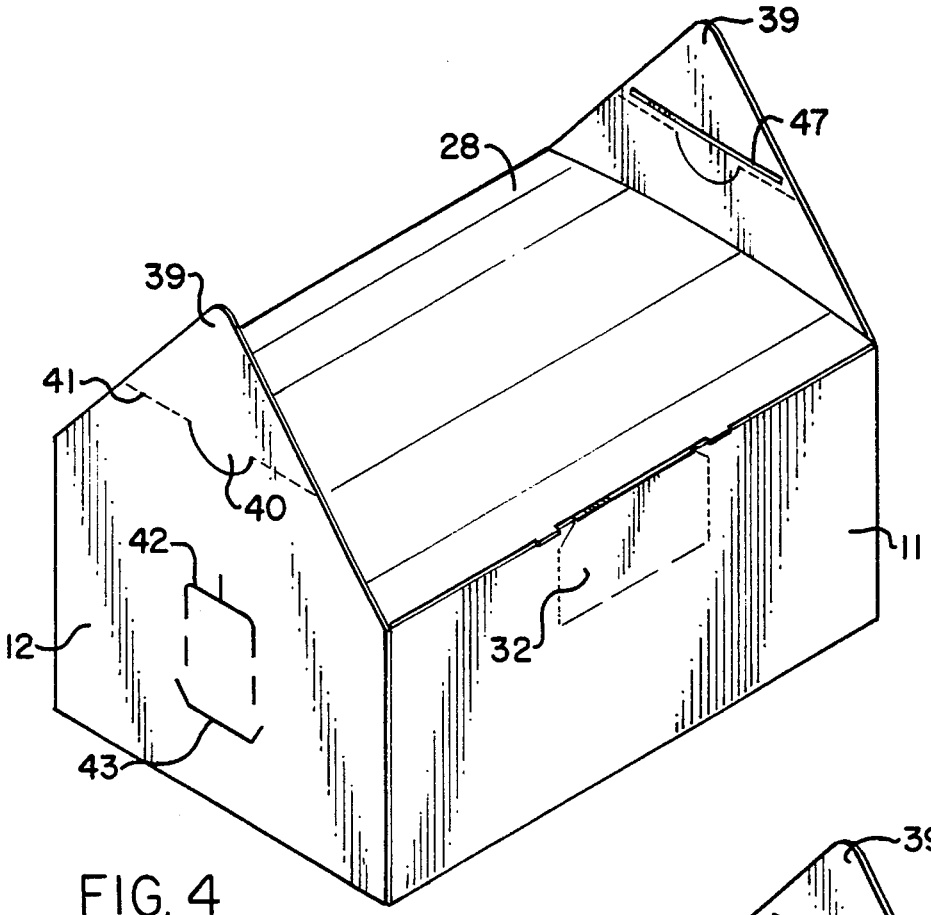
FIG. 4 shows the carton of FIG. 4 in its closed condition.
Figure 5:
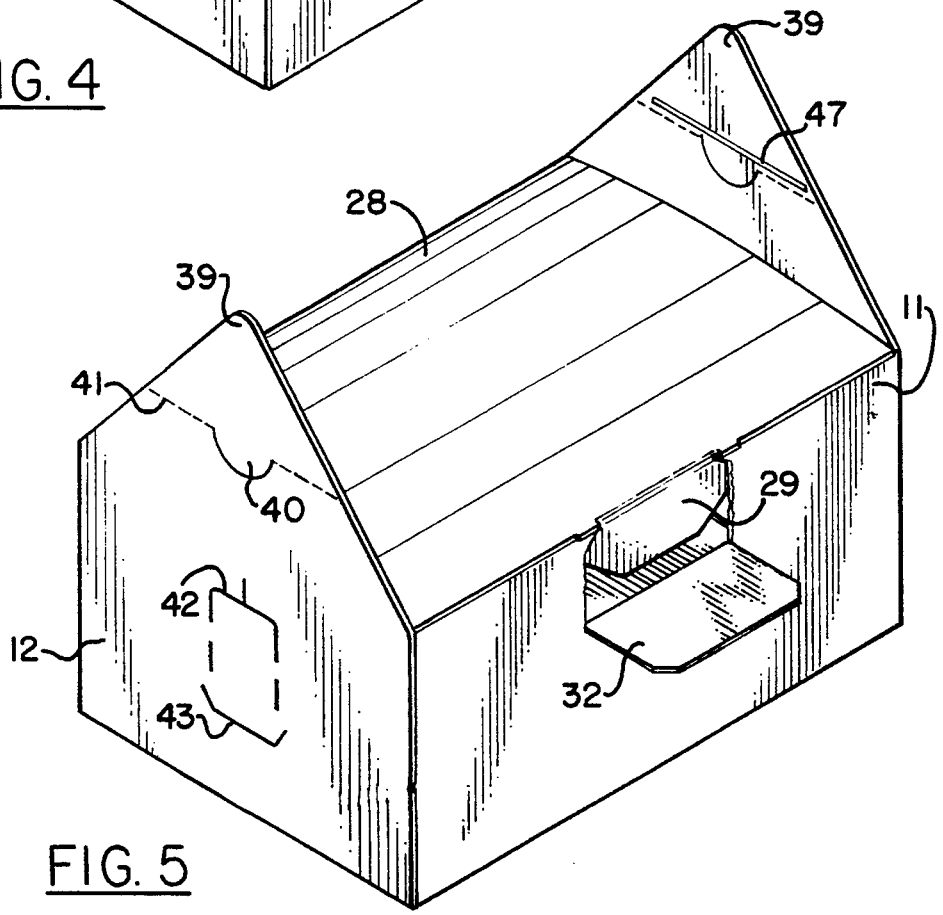
FIG. 5 illustrates the carton of FIG. 4 with the access flap detached for opening the carton.

FIG. 2 illustrates the blank 10 with the auto bottom flaps folded inside, and the glue flap 20 adhered to side wall 14. The auto bottom flaps are designed to fold upwardly between the primary carton side walls when the carton is collapsed as shown in FIG. 2. The formed cartons are preferably shipped and stored in this configuration. When ready for use, the carton is squared as shown in FIG. 3 causing the auto bottom to be formed. At this point in time, the carton can be filled and the lid 28 closed by inserting locking tongue 29 in slot 44. Insertion of tongue 29 in slot 44 causes the shoulder portions 36, 37 to become lodged in place for a secure closure as shown in FIG. 4. However, a closed carton can be readily opened as shown in FIG. 5, by tearing the access flap 32 along perforated lines 33, 34 and folding it outwardly to expose the tongue element 29.

Figure 7:
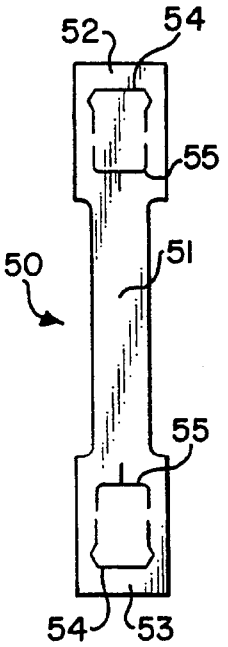
FIG. 7 is a plan view of a typical handle element for the carton of FIG. 4; and, FIG. 8 is a perspective view showing a carton with a handle attached.
Figure 6:
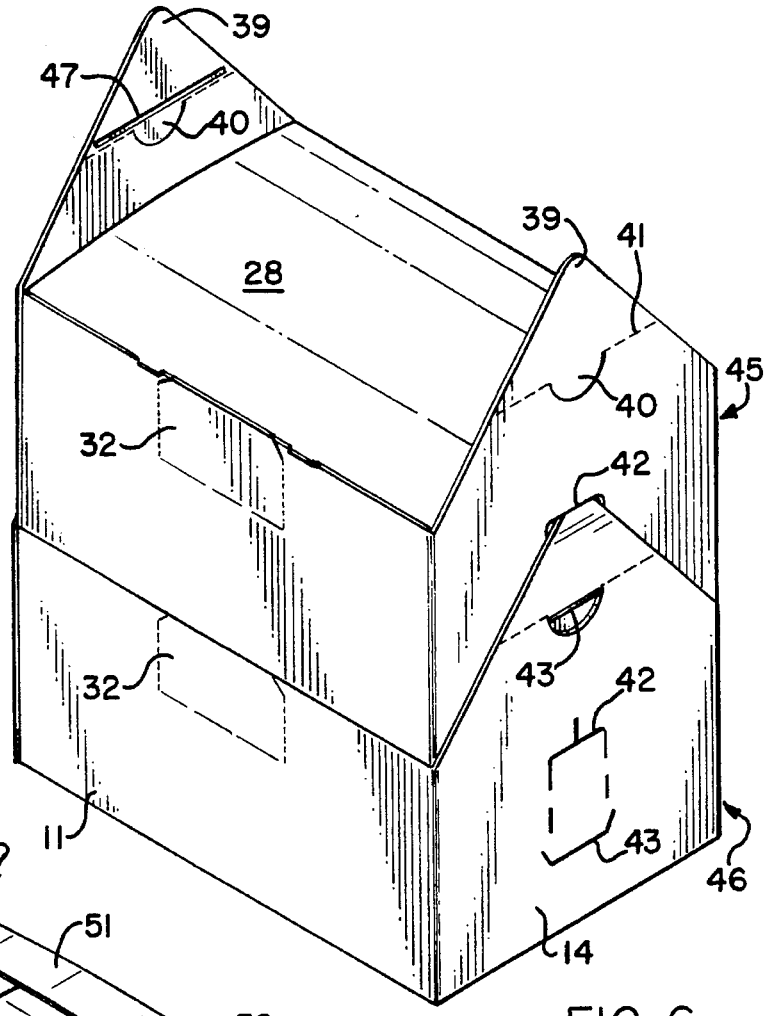
FIG. 6 shows two of the cartons of FIG. 4 in stacked condition.
Figure 8:
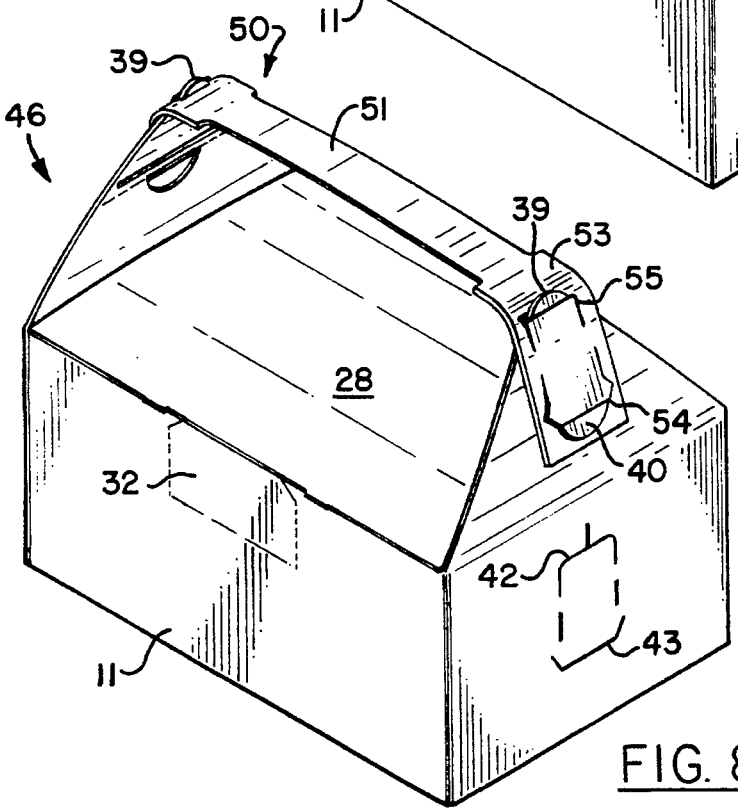

FIG. 6 illustrates two filled and closed cartons as shown in FIG. 4, stacked and secured together. This is readily accomplished by manipulating the apexes 39 and tab elements 40 of the lower most carton 46 so that these elements fit into the opposed locking slots 42, 43 respectively, of the upper carton 45. Once secured, the cartons may be readily separated by disengaging the apexes and the tab elements from their locking slots or by tearing off the side wall extensions of the engaged cartons along the perforated lines 41. Moreover, as mentioned hereinbefore, either single or stacked cartons may be carried with the use of a separate handle element 50 illustrated for example in FIG. 7. Handle element 50 preferably includes a narrow intermediate portion 51 which provides a hand grip, with slightly enlarged end portions 52, 53 which include means for attaching the handle to the carton. The means located in each enlarged end portion 52, 53 include a pair of opposed locking slots 54, 55 designed to cooperate with and become engaged with each apex 39 of the side wall extensions and each tab element 40 cut in the side wall extensions. FIG. 9 illustrates a single carton 46 with a handle 50 attached for ease in carrying.

From the above description of a preferred embodiment of the present invention, it is believed that the novel construction and numerous advantages of the carton disclosed will be readily apparent to one skilled in the art. It is also believed that various modifications in the details of construction of the invention may be made by those skilled in the art without departing from the scope of the invention as defined in the appended claims.

What is claimed is:

1. In a carton formed from a single blank of paperboard or the like and having a plurality of adjacent body forming panels foldably attached to one another along fold lines, a glue flap foldably attached along the free edge of one of said body forming panels and adhered to another body forming panel to provide side walls, a rear wall and a front wall for the carton, and a plurality of bottom closure flaps foldably attached to the bottoms of the body forming panels, the improvement comprising:

(a) a lid panel foldably attached to the upper edge of the rear wall of said carton along a first fold line;

(b) a locking tongue foldably attached to an edge of said lid panel opposite the foldable connection with said rear wall, said locking tongue including a first, centrally located tapered portion with a pair of adjacent shoulder portions, one at each side thereof;

(c) a dust flap foldably attached to the upper edge of the front wall of said carton along a second fold line;

(d) a locking slot adapted to cooperate with the locking tongue of paragraph (b) located substantially centrally along the second fold line connecting the dust flap to the front wall;

(e) an access flap formed within the front wall of the carton by a pair of spaced apart perforated lines which are connected to one another by a fold line, and having an exposed leading edge located adjacent to said locking slot, which provides access to the locking tongue of paragraph (b) when it is securely locked in the locking slot of paragraph (d) to open the carton;

(f) a pair of extension panels integral with the side walls of said carton which extend above the nominal height of the front and rear walls of said carton at two opposed sides of said carton wherein said extension panels each include a first apex portion formed in the shape of a locking tab at its highest point, and a second, integral locking tab cut therefrom along a perforated line located between the apex locking tab and the nominal height of the front and rear walls; and, (g) a pair of oppositely disposed secondary locking slots cut in each side wall of the carton for accepting the apex locking tabs and second, integral locking tabs of another carton when two or more cartons are stacked on top of one another.

2. The carton of claim 1 which further includes a handle element, said handle element including a first centrally located, elongated narrow section which provides a hand grip section, and a pair of end sections of greater width than said narrow section which provide attachment points to said carton, said end sections each including a pair of oppositely disposed handle locking slots cut therein for accepting the apex locking tabs and second, integral locking tabs of a carton when the handle is attached to the carton.

3. A carryout container for fast food products comprising a stack of separate cartons of substantially the same configuration, each having a front wall, rear wall, and a pair of opposed side walls, said side walls each including extension panels integral therewith which extend above the nominal height of said carton walls, said extension panels each terminating at their uppermost extremities in tab portions and including at locations between the nominal height of said carton walls and said uppermost extremities tab elements formed in each side wall extension by cut lines, said side walls each further including a pair of opposed locking slots formed in the side walls by cut lines, wherein said stacked cartons are joined to one another by interlocking the tab portions and tab elements of a lower carton within the side wall locking slots of the next upper carton until all of the stacked cartons are linked together.

* * * * *